US005720633A

United States Patent [19]

Krivec

[11] Patent Number: 5,720,633

[45] Date of Patent: Feb. 24, 1998

[54] LINEAR OPENING BOOSTER CLAMP

[75] Inventor: Bert Krivec, Waukesha, Wis.

[73] Assignee: Snap-on Technologies, Inc., Lincolnshire, Ill.

[21] Appl. No.: 458,798

[22] Filed: Jun. 2, 1995

[51] Int. Cl.[6] ..... H01R 4/48

[52] U.S. Cl. ..... 439/759; 439/482

[58] Field of Search ..... 439/504, 506, 439/726, 729, 755, 759, 482; 324/555, 556; 219/143

[56] References Cited

U.S. PATENT DOCUMENTS

| | | | |
|---|---|---|---|
| 1,604,069 | 10/1926 | Owen | 219/143 |
| 1,682,523 | 8/1928 | James | 219/143 |
| 2,168,250 | 8/1939 | Toiberg et al. | 439/759 |
| 3,045,109 | 7/1962 | Heggy | 219/143 |
| 3,996,511 | 12/1976 | Baer | 324/556 |
| 4,025,153 | 5/1977 | Rodenbaugh | 439/819 |
| 4,263,547 | 4/1981 | Johnson | 324/149 |
| 4,342,497 | 8/1982 | Morrison | 439/759 |
| 4,470,654 | 9/1984 | Friedman | 439/759 |
| 4,540,940 | 9/1985 | Nolan | 324/133 |
| 4,778,408 | 10/1988 | Morrison | 439/759 |
| 4,826,457 | 5/1989 | Varatta | 439/755 |
| 4,854,901 | 8/1989 | Vernachio | 439/755 |
| 4,948,383 | 8/1990 | Tompkins | 439/755 |
| 5,021,008 | 6/1991 | Scherer | 439/504 |
| 5,082,456 | 1/1992 | Lan | 439/504 |
| 5,457,392 | 10/1995 | Filipescu | 324/555 |

FOREIGN PATENT DOCUMENTS

| | | | |
|---|---|---|---|
| Ad-559200 | 5/1954 | France | 219/143 |

*Primary Examiner*—Neil Abrams
*Attorney, Agent, or Firm*—Emrich & Dithmar

[57] ABSTRACT

A linear clamp for releasably engaging an electrical connector is provided. The clamp includes a housing having a hand grip portion and an elongated barrel portion having a longitudinal axis, a fixed jaw carried by the barrel portion, and a moveable member having a moveable jaw thereon axially aligned with and facing the fixed jaw, wherein the longitudinal axis passes through the jaws. The clamp further includes resilient means for urging the moveable jaw toward the fixed jaw, and a lever pivotally connected to the hand grip portion and coupled to the moveable member for linearly moving the moveable jaw along the longitudinal axis away from the fixed jaw.

15 Claims, 2 Drawing Sheets

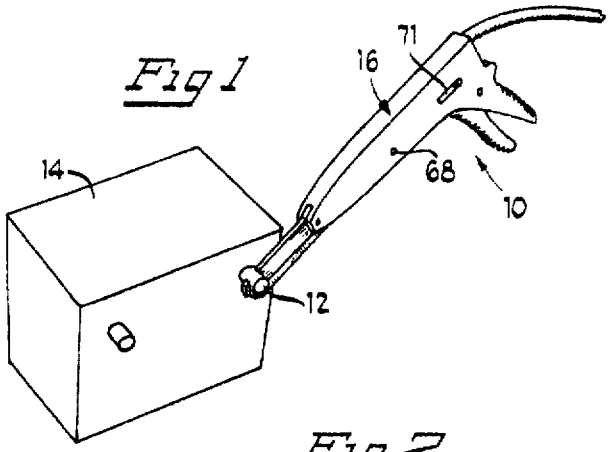
Fig 1
14
16
71
68
10
12
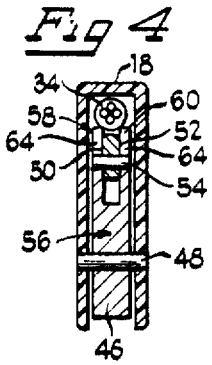
Fig 4
18
34
60
58
52
64
64
50
54
56
48
46
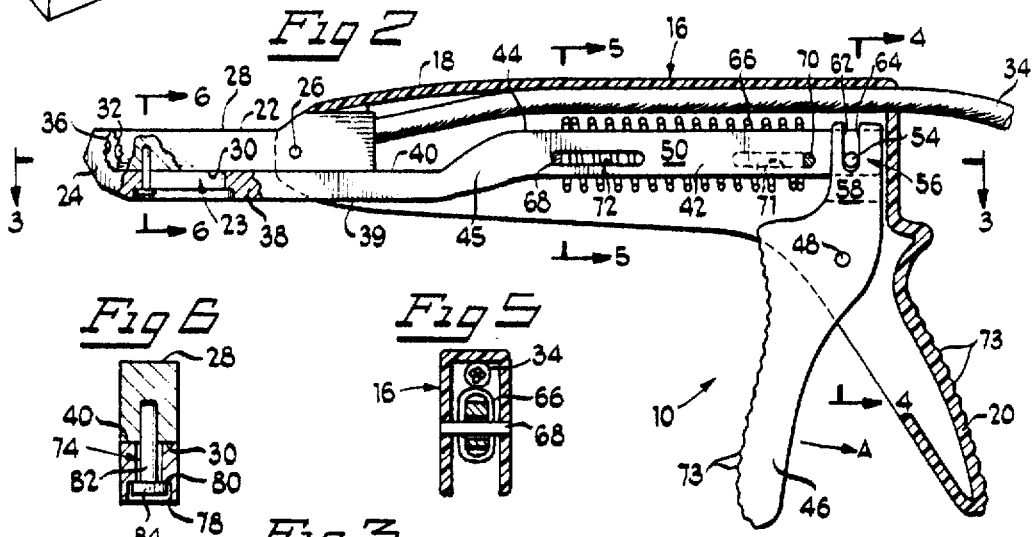
Fig 2
16
18
44
5
66
70
62
64
4
34
28
26
22
6
32
36
30
40
50
54
24
3
23
38
39
45
68
72
42
71
58
56
3
6
5
48
73
10
4
20
A
73
46
Fig 6
28
40
74
30
82
80
84
78
Fig 5
34
16
66
68
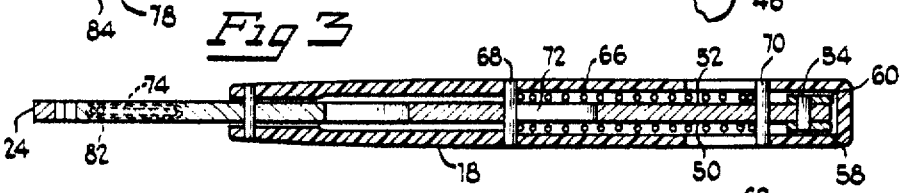
Fig 3
68
72
66
52
70
54
60
74
24
82
18
50
58
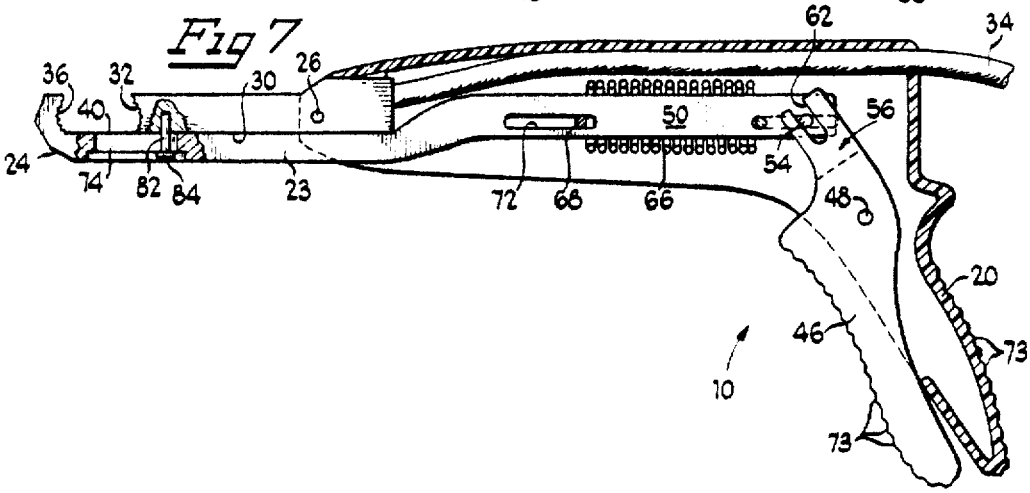
Fig 7
62
34
36
32
26
30
40
50
56
24
74
82
84
23
72
68
66
54
48
20
46
73
10
73

162
156
160
186
188
154
146
11
110
166
168
142
122
123
138
10
192
190
158

LINEAR OPENING BOOSTER CLAMP

BACKGROUND OF THE INVENTION

1. Field of the Invention

The present invention relates to battery or booster clamps and more particularly to clamps which have jaw portions which open linearly with respect to each other.

2. Description of the Prior Art

Conventional pivotally opening battery or booster clamps typically have two levers, a jaw portion attached to each lever for clamping onto a battery electrode and a joint comprised of a helical spring disposed about a rivet which pivotally connects the two levers of the booster clamp. The spring is adapted to bias the jaw portions of the clamp together to maintain the clamp in a closed position. The clamp is opened by manually squeezing the two levers toward one another to separate the jaw portions.

Though this type of clamp is widely used, it has severe limitations. It is very difficult to use in tightly cramped quarters. This is of special concern since many cars today are mid-size or smaller and have very little work space under the hood and often have batteries equipped with side terminals in close proximity to a fender. Users of these conventional pivoted lever clamps, therefore, often have trouble reaching the terminal of a battery to attach the booster clamp and have to attach the clamp in a very slow and careful process so that the clamp does not contact conductive portions of the car to make an unwanted electrical contact.

SUMMARY OF THE INVENTION

It is a general object of the invention to provide a booster clamp which avoids the disadvantages of prior clamps while affording additional structural and operating advantages.

An important feature of the present invention is the provision of a booster clamp which can be operated quickly and effectively in cramped quarters.

Another feature of the present invention is the provision of a booster clamp having the ability to clamp onto a connection previously unreachable with a conventional clamp.

Another feature of the present invention is the provision of a booster clamp which is of simple and economical construction.

These and other features of the present invention are attained by providing a linear clamp for releasably engaging an electrical connector. The linear clamp including a housing having a hand grip portion and an elongated barrel portion having a longitudinal axis, a fixed jaw carried by the barrel portion, and a moveable member having a moveable jaw thereon axially aligned with and facing the fixed jaw, wherein the longitudinal axis passes through the jaws. The clamp further includes resilient means for urging the moveable jaw toward the fixed jaw, and a lever pivotally connected to the hand grip portion and coupled to the moveable member for linearly moving the moveable jaw along the longitudinal axis away from the fixed jaw.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a perspective view of a linear booster clamp of the present invention in electrical contact with a side terminal of a battery;

FIG. 2 is an enlarged sectional view of the clamp of FIG. 1 in its normal closed condition, having portions broken away for clarity;

FIG. 3 is a sectional view taken generally along the line 3—3 in FIG. 2;

FIG. 4 is a sectional view taken generally along the line 4—4 in FIG. 2;

FIG. 5 is a sectional view taken generally along the line 5—5 in FIG. 2;

FIG. 6 is a sectional view taken generally along the line 6—6 in FIG. 2;

FIG. 7 is a view similar to FIG. 2 illustrating the clamp of FIG. 1, in an open position;

DETAILED DESCRIPTION OF THE PREFERRED EMBODIMENTS

Figures 8, 9, 10, 11:
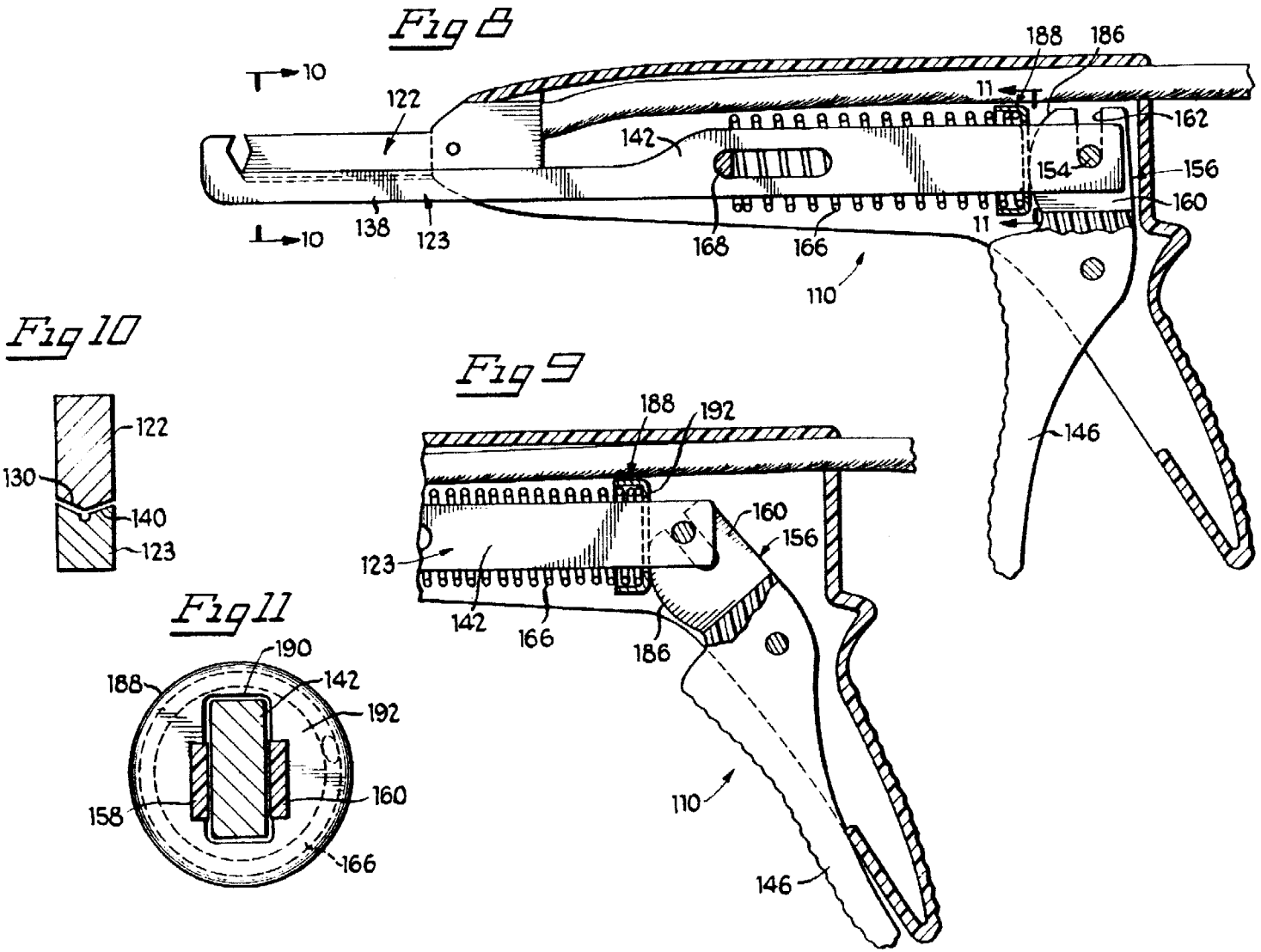
FIG. 8 is a further enlarged sectional view, similar to FIG. 2, illustrating an alternative embodiment of the clamp of the present invention.
FIG. 9 is a fragmentary sectional view illustrating portions of the clamp of FIG. 8 in an open position.
FIG. 10 is a still further enlarged sectional view taken generally along the line 10—10 in FIG. 8.
FIG. 11 is a further enlarged sectional view taken generally along the line 11—11 in FIG. 8.

Referring to FIG. 1, a linear booster clamp 10 is illustrated attached to a side terminal 12 of a battery 14. As best seen in FIGS. 1 and 2, the linear booster clamp 10 includes a housing 16 having an elongated barrel portion 18 and a hand grip 20.

The linear booster clamp 10 further includes a fixed jaw 22 and a moveable member 23 having a moveable jaw 24. Both the fixed jaw 22 and moveable jaw 24 are comprised of an electrically conducting material such as steel or copper. The fixed jaw 22 is non-moveable relative to the housing 16 and is connected by a pin 26 (or any conventional means) to the barrel portion 18 of the housing 16. The fixed jaw 22 is a straight bar having a top surface 28 and a bottom surface 30 and a first contact surface 32 for making electrical contact with a connector such as a battery electrode. The fixed jaw 22 is also electrically connected to a cable 34 by any conventional means.

The moveable jaw 24 is moveable, as discussed below, with respect to the fixed jaw 22. The moveable jaw 24 includes a second contact surface 36 which faces and is opposite the first contact surface 32 of fixed jaw 22. Together, the first and second contact surfaces 32, 36 are adapted to form an electrical connection with an electric connector by clamping engagement therewith.

The moveable member 23 has a first portion 38 which has a bottom surface 39 and a top surface 40 which is disposed below and in slidable contact with the bottom surface 30 of the fixed jaw 22 and a second portion 42 which has a top surface 44 disposed above the bottom surface 30 of the fixed jaw 22. An inclined portion 45 joins the portions 38 and 42. The linear booster clamp 10 has a longitudinal axis, substantially parallel to the first and second portions 38 and 42 of the moveable member 23, which passes through barrel portion 18, first contact surface 32 of the fixed jaw 22 and second contact surface 36 of the moveable jaw 24. As discussed below, the second contact surface 36 of the moveable jaw 24 moves linearly along this axis when the clamp 10 is opened and closed. The moveable jaw 24 is disposed at a greater distance along the longitudinal axis from the hand grip 20 than the fixed jaw 22.

The linear booster clamp 10 further includes a lever 46 (or trigger) which is pivotally connected by a pin 48 to the hand grip 20 of the housing 16. To prevent unwanted electrical connections, the housing 16 and lever 46 are ideally made out of a hard plastic but may be formed of any suitable non-conductive material.

As best seen in FIGS. 2 and 4, the moveable member 23 has two side surfaces 50, 52 and a bearing pin 54 which passes through the second portion 42 of the moveable member 23 and is substantially normal to the longitudinal axis. The lever 46 has a clevis-shaped first end 56 receiving the rear end of moveable member 23. The first end 56 of the lever 46 has a first wall 58 adjacent side surface 50 and a second wall 60 adjacent side surface 52. The first and second walls 58, 60 are separated by a distance slightly greater than the distance between the side surfaces 50, 52 of the moveable member 23. Each of the first and second walls 58, 60 has an open ended slot 62, the slots 62 respectively receiving opposite ends of the bearing pin 54. Each slot 62 also has a bearing surface 64, as discussed below.

Normally, as seen in FIG. 2, the moveable jaw 24 is biased toward the fixed jaw 22 to maintain the clamp 10 in a closed or clamped position. This biasing is accomplished by having a helical compression spring 66 disposed about the second portion 42 of the moveable member 23. As best seen in FIGS. 2 and 5, one end of the spring 66 bears against a flat-sided pin 68 which is substantially normal to the longitudinal axis and attached to the barrel portion 18 of the housing 16. The other end of the spring 66 bears against a pin 70 disposed substantially normal to the longitudinal axis and extending from the side surfaces 50, 52 of the second portion 42 of the moveable member 23 through a pair of slots 71 disposed in the barrel portion 18 of the housing 16. The second portion 42 also includes a slot 72 running substantially parallel to the longitudinal axis and receiving the pin 68 therethrough. Slots 71 and 72 permit the moveable member 23 to move linearly along the longitudinal axis without any interference from the pins 68 and 70.

The lever 46 and the hand grip 20 are configured to have a pistol-grip action. A user places his palm against the hand grip 20 and, using the fingers of the same hand, squeezes the lever 46 or "trigger" towards the grip 20 to open the linear booster clamp 10. The lever 46 and the hand grip 20 may have a plurality of ridges 73, which provide the user with a better grip.

To open the linear booster clamp 10, lever 46 is manually moved, as just described, in the direction of arrow A in FIG. 2, towards the hand grip 20. Bearing surface 64 of the first and second walls 58, 60 bear on the bearing pin 54 to linearly push the moveable member 23 and the second contact surface 36 of the moveable jaw 24 along the longitudinal axis and away from the first contact surface 32, compressing spring 66, as seen in FIG. 7. The lever 46 is so configured that the force necessary to squeeze the lever 46 toward the hand grip 20 to compress spring 66 and open the linear booster clamp 10 is smaller than the force exerted by the spring 66 to bias the moveable jaw 24 toward the fixed jaw 22.

Additionally, the linear booster clamp 10 provides means to keep the first and second contact surfaces 32, 36 of the fixed and moveable jaws 22, 24 axially aligned, so that the moveable member 23 and its moveable jaw 24 move substantially only parallel to the longitudinal axis. This alignment allows the linear booster clamp 10 to easily and efficiently clamp onto an electrical connector.

The alignment means include the slot 72 and pin 68 which prevent the moveable jaw 24 from moving vertically with respect to fixed jaw 22, so that the top surface 40 of the first portion 38 remains in slidable contact with the bottom surface 30 of the fixed jaw 22.

Additionally, the first portion 38 of the moveable member 23 includes a slot 74 which passes through the top and bottom surfaces 40, 39. The slot 74 has a countersunk portion 78 in the bottom surface 39 such that an peripheral shoulder 80 is formed (see FIG. 6). A pin 82 extends through the slot 74 and is fixed to the fixed jaw 22, the pin 82 having an enlarged head 84 receivable in the countersunk portion 78 against the peripheral shoulder 80 to prevent the moveable member 23 from moving horizontally or vertically relative to the longitudinal axis, thereby to keep the first and second contact surfaces 32, 36 of the fixed and moveable jaws 22, 24 axially aligned.

An alternative linear booster clamp 110 is illustrated in FIGS. 8–11 which is identical to the linear booster clamp 10 illustrated in FIGS. 1–7 except as described below.

First, the linear booster clamp 110 is biased toward a closed position in a slightly different manner. Lever 146 has a clevis-shaped first end 156 having separated walls 158, 160 each having an arcuate bearing surface 186. Helical spring 166 is disposed about the second portion 142 of moveable member 123 and has the rear end thereof seated in a cap 188. Cap 188 has a rectangular aperture 190 therein, through which the second portion 142 of moveable member 123 passes, and a bearing surface 192. The forward end of spring 166 bears against flat-sided pin 168 and cap 188 bears against arcuate surfaces 186 of the walls 158, 160 of the lever 146 which, in turn, act on the moveable member 123 through the pin 154 in open slots 162.

Linear booster clamp 110 also includes slightly different alignment means to allow the moveable member 123 to move substantially only along the longitudinal axis. As best seen in FIG. 10, the bottom surface 130 of fixed jaw 122 and the top surface 140 of the first portion 138 of moveable member 123 are both non-planar and each have a mateable, non-linear, generally V-shaped, transverse cross-sectional shape which together prevent the moveable member 123 from moving horizontally with respect to the longitudinal axis. While FIG. 10 illustrates the bottom surface 130 with a male V-shape and the top surface 140 with a female V-shape, these surfaces 130, 140 can have any other mateable non-linear cross-sectional shapes that together prevent non-linear movement of the moveable member 123.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A battery clamp for releasably engaging a battery terminal comprising:

a housing having a hand grip portion engageable with the palm of a user's hand and an elongated barrel portion having a longitudinal axis;

a fixed jaw carried by the barrel portion;

a moveable member having a moveable jaw thereon axially aligned with and facing the fixed jaw, wherein the longitudinal axis passes through the jaws;

resilient means for urging the moveable jaw toward the fixed jaw; and a lever engageable with the fingers of the user's hand pivotally connected to the hand grip portion and coupled to the moveable member for linearly moving the moveable jaw along the longitudinal axis away from the fixed jaw, the lever and the hand grip forming a pistol grip configuration.

2. The clamp of claim 1, wherein the distance along the longitudinal axis between the moveable jaw and the grip portion is greater than the distance between the fixed jaw and the grip portion.

3. The clamp of claim 1, wherein the moveable member has first and second ends and wherein the moveable jaw is disposed at the first end and the second end is disposed within the housing.

4. The clamp of claim 3, wherein the resilient means includes a helical spring disposed about the moveable member.

5. The clamp of claim 4, wherein the spring is a compression spring.

6. The clamp of claim 3, and further comprising a pin substantially normal to the longitudinal axis and extending from the moveable member and a slot disposed at a first end of the lever for receiving the pin.

7. The clamp of claim 1, and further comprising alignment means for preventing the moveable jaw from moving perpendicular to the longitudinal axis, whereby the fixed and moveable jaws are maintained in axial alignment.

8. The clamp of claim 7, wherein the fixed jaw includes a straight bar having a top surface and a bottom surface and wherein the moveable member includes a first portion having a top surface disposed below and in slidable contact with the bottom surface of the straight bar and a second portion having a top surface disposed above the bottom surface of the straight bar.

9. The clamp of claim 8, wherein the alignment means includes a slot disposed through the first portion of the moveable member and a pin disposed through the slot and connected to the straight bar.

10. The clamp of claim 8, wherein the alignment means includes the bottom surface of the straight bar having a transverse cross-sectional first non-linear shape and of the top surface of the first portion of the moveable member having a transverse cross-sectional second non-linear shape mateable with the first non-linear shape.

11. The clamp of claim 10, wherein the alignment means further includes a slot disposed through the moveable member and a first pin attached to the housing and substantially normal to the longitudinal axis.

12. The clamp of claim 11, wherein the lever includes a first end having an arcuate bearing surface and wherein the resilient means bears against the bearing surface and the first pin.

13. The clamp of claim 12 where the resilient means includes a cap and a helical compression spring disposed about the moveable member and having a portion disposed in the cap, wherein the cap bears against the bearing surface.

14. The clamp of claim 11, and further comprising a bearing pin disposed through and extending from the second portion of the moveable member, wherein the resilient means bears against the first pin and the bearing pin.

15. A battery clamp for releasably engaging a battery terminal comprising:

a housing having a hand grip portion engageable with the palm of a user's hand and an elongated barrel portion having a longitudinal axis;

a fixed jaw carried by the barrel portion;

a moveable member having a moveable jaw thereon axially aligned with and facing the fixed jaw, wherein the longitudinal axis passes through the jaws;

resilient means for urging the moveable jaw toward the fixed jaw; and a lever pivotally connected to the hand grip portion and coupled to the moveable member for linearly moving the moveable jaw along the longitudinal axis away from the fixed jaw, the lever having a finger engaging end engageable with the fingers of the user's hand and an output end adjacent the resilient means and a mechanical advantage greater than one.

* * * * *